US012270273B1

(12) United States Patent
Martinez et al.

(10) Patent No.: US 12,270,273 B1
(45) Date of Patent: Apr. 8, 2025

(54) STINGER FOR INSERTION INTO A POLISHED BORE RECEPTACLE, PRODUCTION TUBING ASSEMBLY INCLUDING A STINGER, AND POLISHED BORE RECEPTACLE AND METHOD FOR INSTALLING PRODUCTION TUBING IN A WELL

(71) Applicant: Interwell Norway AS, Hafrsfjord (NO)

(72) Inventors: Julio Cesar Martinez, Cypress, TX (US); Vijay Kumar Keerthivasan, Sandnes (NO)

(73) Assignee: Interwell Norway AS, Hafrsfjord (NO)

( * ) Notice: Subject to any disclaimer, the term of this patent is extended or adjusted under 35 U.S.C. 154(b) by 0 days.

(21) Appl. No.: 18/442,838

(22) Filed: Feb. 15, 2024

(51) Int. Cl.
*E21B 33/12* (2006.01)
*E21B 23/06* (2006.01)

(52) U.S. Cl.
CPC ..... *E21B 33/1208* (2013.01); *E21B 23/06* (2013.01); *E21B 2200/08* (2020.05)

(58) Field of Classification Search
CPC ... E21B 33/1208; E21B 23/06; E21B 2200/08
See application file for complete search history.

(56) References Cited

U.S. PATENT DOCUMENTS

2012/0111636 A1* 5/2012 Steele ..... E21B 7/061 175/75

FOREIGN PATENT DOCUMENTS

NO 328882 B1 6/2010
NO 338780 B1 10/2016

* cited by examiner

*Primary Examiner* — James G Sayre
(74) *Attorney, Agent, or Firm* — Osha Bergman Watanabe & Burton LLP

(57) ABSTRACT

A stinger for insertion into a polished bore receptacle is operable between at least two operational states. The at least two operational states include a closed state in which fluid flow through the through bore of the plug section is prevented and an open state in which fluid flow through the through bore of the plug section is allowed. An actuating system is operating the stinger from the closed state to the open state. The stinger is brought to the open state from the closed state as the stinger is pushed down into polished bore receptacle.

10 Claims, 9 Drawing Sheets

STINGER FOR INSERTION INTO A POLISHED BORE RECEPTACLE, PRODUCTION TUBING ASSEMBLY INCLUDING A STINGER, AND POLISHED BORE RECEPTACLE AND METHOD FOR INSTALLING PRODUCTION TUBING IN A WELL

TECHNICAL FIELD

The present invention relates to a stinger for insertion into a polished bore receptacle. The present invention also relates to a production tubing assembly. The present invention also relates to a method for installing a production tubing in a well.

BACKGROUND

A polished bore receptacle (often referred to as a PBR) is typically used as part of a production tubing for two purposes, either as an expansion joint when longitudinal movement is expected in the production tubing or as a separation tool for allowing removal of the production tubing string while allowing the polished bore and anchor seal assembly set in the packer. The polished bore receptacle PBR is typically forming the lower part of the production tubing.

The upper part of the completion is formed by a so-called stinger (or PBR stinger) which is inserted into the upper end of the polished bore receptacle. The PBR stinger is typically forming the upper part of the production tubing.

In accordance with one or more embodiments, one object of the present invention is to provide an alternative stinger for a polished bore receptacle and to provide a method for installing a production tubing in a well.

SUMMARY

The present invention relates to a stinger for insertion into a polished bore receptacle, wherein the polished bore receptacle is forming an upper end of a lower production tubing and wherein the lower production tubing is closed by a lower barrier;

wherein the stinger comprises a pipe section and a plug section; wherein the pipe section comprises a pipe having a through bore; wherein the plug section comprises a housing having a through bore; wherein an upper end of the housing is connected to, or provided as part of, a lower end of the pipe and the through bore of the housing is aligned below the through bore of the pipe;

wherein the stinger is operable between at least two operational states, wherein the at least two operational states comprise a closed state in which fluid flow through the through bore of the plug section is prevented and an open state in which fluid flow through the through bore of the plug section is allowed;

wherein the plug section comprises a frangible plug body sealingly engaged within the through bore of the housing in the closed state;

wherein the plug section comprises an actuating system for operating the stinger from the closed state to the open state; wherein the actuating system comprises:

a disintegration device provided within the bore above the frangible plug body;

an upper supporting device connected to the housing and supporting an upper side of the frangible plug body within the bore in the closed state and released from the housing in the open state, thereby allowing upward movement of the frangible plug body into contact with the disintegration device in the open state; and a releasing system for releasably connecting the upper supporting device to the housing in the closed state;

wherein the stinger is brought to the open state from the closed state as the stinger is pushed down into polished bore receptacle.

The operation of pushing the stinger down into polished bore receptacle is causing an increase in pressure within the plug section below the frangible plug body to release the releasing system. More specifically, the operation of pushing the stinger down into polished bore receptacle is causing an increase in pressure within the plug section below the frangible plug body and above the lower barrier to release the releasing system.

The increase in pressure within the plug section below the frangible plug body is a result of a reduced volume within the polished bore receptacle between the lower barrier and the frangible plug body.

The stinger is sealingly engaged within the polished bore receptacle when inserted into the polished bore receptacle. The stinger is sealingly engaged within the polished bore receptacle when inserted into the polished bore receptacle by means of a sealing assembly provided within the polished bore receptacle. The stinger may be inserted through the sealing assembly when inserted into the polished bore receptacle.

The releasing system may be defined with a predetermined releasing threshold parameter representing the increase in pressure within the plug section at which the releasing system releases the upper supporting device from the housing.

The predetermined releasing threshold parameter may be one of the following:

a predetermined fluid pressure within the bore of the housing below the frangible plug body; or a predetermined number of fluid pressure cycles within the bore of the housing below the frangible plug body.

The fluid pressure within the bore may be the objective fluid pressure within the bore. The fluid pressure within the bore may be the relative fluid pressure within the bore. The relative fluid pressure within the bore may be the difference between the fluid pressure within the bore of the housing below the frangible plug body and the fluid pressure within the bore of the housing above the frangible plug body. The relative fluid pressure within the bore may be the difference between the fluid pressure within the bore of the housing below the frangible plug body and the fluid pressure outside of the housing.

The number of fluid pressure cycles within the bore of the housing below the frangible plug body may also be a number of objective fluid pressure cycles or a number of relative fluid pressure cycles.

The releasing system may comprise a shear element.

The shear element may be sheared off by a predetermined force defined by the difference between the fluid pressure within the bore of the housing below the frangible plug body and the fluid pressure within the bore of the housing above the frangible plug body.

The releasing system may comprise an electric actuator for releasably connecting the upper supporting device to the housing and a pressure sensor for sensing the fluid pressure within the bore of the housing below the frangible plug body, wherein the pressure sensor may be configured to send an actuation signal to the electric actuator when the predetermined fluid pressure may be measured.

The electric actuator may be configured to maintain the position of the upper supporting device in the closed state and to move the upper supporting device away from the frangible plug body in the open state, thereby allowing the frangible plug body to move into contact with the disintegration device.

The electric actuator may comprise a solenoid and an actuation rod, wherein the actuation rod is moved when the solenoid is powered with electric current. The releasing system may comprise a battery for supplying electric power to the pressure sensor and/or the electric actuator. The electric actuator may be an electrically ignited pyrotechnic actuator. The releasing system may comprise a digital signal processor configured to send an actuating signal to the actuator based on information received from the sensor.

The releasing system may further comprise a shear element for connecting the supporting device to the housing or for connecting the actuation rod to the housing in the closed state. The electric actuator may be configured to shear off the shear element.

The pressure sensor may be configured to measure the objective fluid pressure in the bore below the frangible plug body.

The releasing system may comprise a pressure cycling mechanism for counting a number of pressure cycles, wherein the upper supporting device may be released from the housing after a measuring a predetermined number of fluid pressure cycles within the bore of the housing below the frangible plug body.

Here, the stinger is brought to the open state from the closed state as the stinger is pushed down into polished bore receptacle and up again a predetermined number of times, causing an increase in pressure and a subsequent decrease in pressure within the plug section below the frangible plug body a predetermined number of times to release the releasing system.

The frangible plug body may be a frangible glass disc. The frangible glass disc may be made of hardened glass. Alternatively, the frangible plug body may be made of a ceramic material.

The frangible plug body may have a cylindrical shape, with an upper chamfered edge and a lower chamfered edge. The chamfered edges are transferring forces from the frangible plug body into the housing. The forces are formed by a pressure difference between the pressure on the upper side of the frangible plug body and the pressure on the lower side of the frangible plug body.

The frangible plug body is sealingly engaged within the through bore of the housing by means of sealing elements provided radially outside of the frangible plug body and radially inside of the housing. The frangible plug body may be sealingly engaged directly within the through bore of the housing. Alternatively, the frangible plug body may be sealingly engaged within a sleeve section, wherein the sleeve section is sealingly engaged within the through bore of the housing.

The upper supporting device may be longitudinally displaceable relative to the housing. The upper supporting device may be a retaining sleeve. The upper supporting device may comprise a slot, groove or recess in which the disintegration device is located.

The disintegration device may be secured to the housing. The disintegration device may comprise a knife or another type of device with a sharp edge, a sharp tip etc.

The pipe may be a production tubing or a completion string. The upper end of the housing may be connected to the lower end of the pipe by means of a threaded connection.

The stinger may be referred to as a polished bore receptacle stinger or PBR stinger.

The stinger, when inserted into the polished bore receptacle, is forming the upper production tubing. The terms "production tubing" and "completion string" are used herein interchangeable for the pipe being used to transfer oil and/or gas from the well and to the topside of the well during the production phase of the well.

According to the above, due to the frangible plug body, it is achieved that the fluid within the bore of the pipe section, and hence the fluid in the bore of the plug section above frangible plug body, is separated from the fluid within the polished bore receptacle. In addition, it is achieved that the fluid within the bore of the pipe section, and hence the fluid in the bore of the plug section above frangible plug body is separated from the fluid radially outside of the stinger and radially outside of the polished bore receptacle.

The present invention also relates to a production tubing assembly comprising a lower production tubing and an upper production tubing above the lower production tubing; wherein an upper end of the lower production tubing comprises a polished bore receptacle;

characterized in that the upper production tubing comprises a stinger according to the above inserted into the polished bore receptacle.

The lower production tubing may be closed by a lower barrier.

The stinger and the polished bore receptacle may be defined with an overlapping region in which the stinger is provided radially inside the polished bore receptacle.

The present invention also relates to a method for installing a production tubing in a well, wherein the method comprises the steps of:

installing a lower production tubing in the well, wherein an upper end of the lower production tubing comprises a polished bore receptacle;

installing a stinger into the polished bore receptacle, wherein fluid flow through the stinger is prevented by a frangible plug body sealingly engaged within a through bore of a housing of a plug section of the stinger when the stinger is in a closed state;

bringing the stinger from the closed state to its open state by pushing the stinger further down into polished bore receptacle, causing an increase in pressure within the plug section below the frangible plug body to disintegrate the frangible plug body.

The stinger may be a stinger according to the above.

The terms "upper", "above", "below" and "lower" are used herein to define parts of the well tool device, when the well tool device is used in a well. "Upper" and "above" refer to a position relatively closer to the well opening and "below" and "lower" refer to a position relatively further away from the well opening. These terms apply both when the well has a vertical and horizontal orientation.

As used herein, the terms "production tubing" and "completion string" are used interchangeably.

As used herein, the term "frangible plug body" may refer to a body of a frangible material of any shape capable of being secured into other parts of the tool and capable of withstanding the pressure ratings for the tool. Due to common well geometry, the disc will typically have a circular cross-sectional shape. Hence, the frangible plug body may be referred to as a frangible disc. The height of the disc may be lower than, equal to or higher than the diameter of the disc.

DETAILED DESCRIPTION

Figure 1:
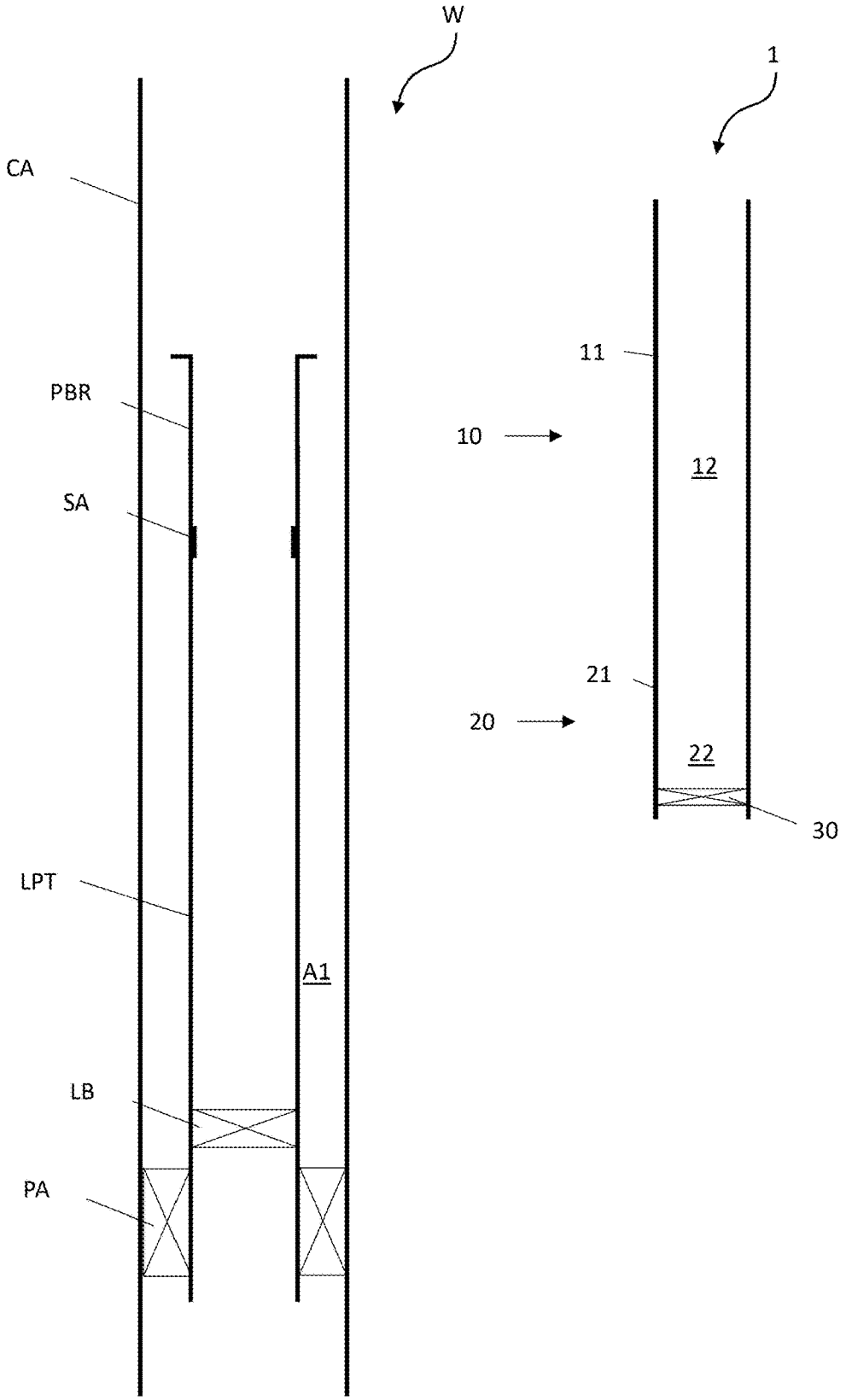
FIG. 1 schematically illustrates the polished bore receptacle and the stinger separate from each other.

Initially, it is referred to FIG. 1. Here it is shown a well W, in which a casing CA has been installed. In addition, a lower section of a production tubing, referred to as a lower production tubing LPT, has been installed inside the casing CA. A packer PA is installed radially outside of the lower production tubing LPT, sealing off an annulus A1 outside of the lower production tubing LPT and inside of the casing CA. A lower barrier LB has been installed inside the lower production tubing LPT.

The lower production tubing LPT comprises a so-called polished bore receptacle PBR in its upper end. The polished bore receptacle PBR comprises a sealing assembly SA.

Figure 2:
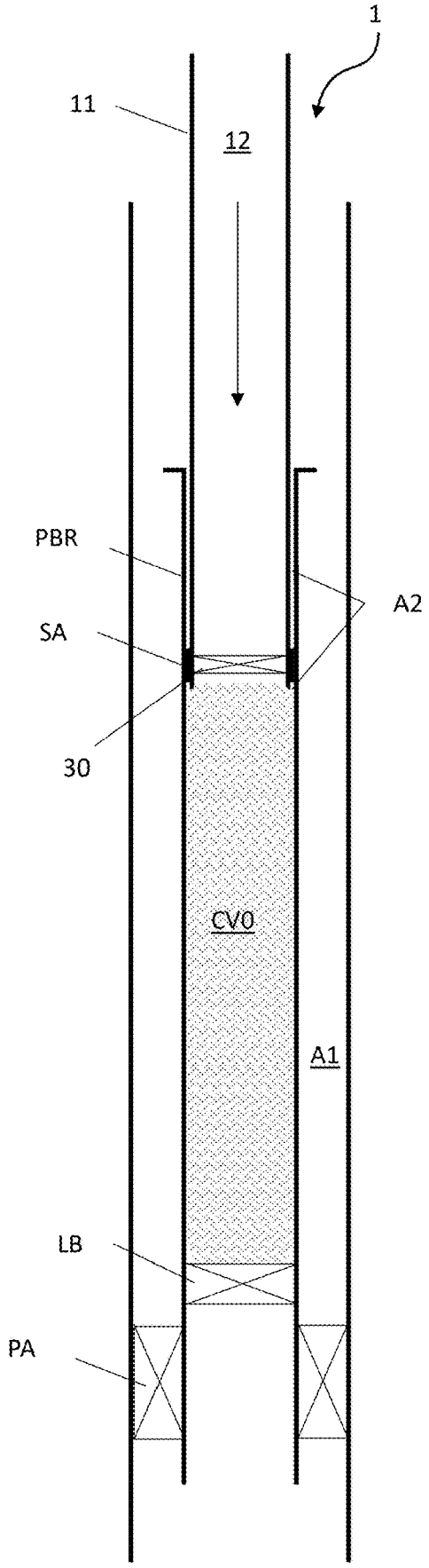
FIG. 2 schematically illustrates the insertion of the stinger into the polished bore receptacle, where a closed volume CV0 is indicating the initially closed volume.

The polished bore receptacle PBR is adapted to receive a stinger 1 by inserting the stinger 1 into the PBR and through the sealing assembly SA as indicated in FIG. 2. The sealing assembly SA is preventing longitudinal fluid flow in an annulus A2 outside of the stinger 1 and inside of the polished bore receptacle PBR.

As shown in FIG. 1, the stinger 1 comprises a pipe section 10 and a plug section 20.

The pipe section 10 comprises a pipe 11 having a through bore 12. As the stinger 1 may have a total length (i.e. measured in the longitudinal direction as indicated by the longitudinal center axis LCA in FIG. 5) of up to ca 30-50 meters, the pipe section 10 may comprise a plurality of pipes connected to each other.

In the upper end, the pipe section 10 comprises a connection interface, typically a tubing hanger, for connection to further pipes or for connection to topside equipment such as a so-called Christmas tree.

The plug section 20 comprises a housing 21 having a through bore 22. The through bore 22 of the housing 21 is aligned below the through bore 12 of the pipe 11.

In FIG. 1, the housing 21 is provided as part of the pipe 11. The plug section 20 further comprises a frangible plug body 30 sealingly engaged within the through bore 22.

Different embodiments of the stinger 1 will be described further in detail below.

Example 1

Figure 5:
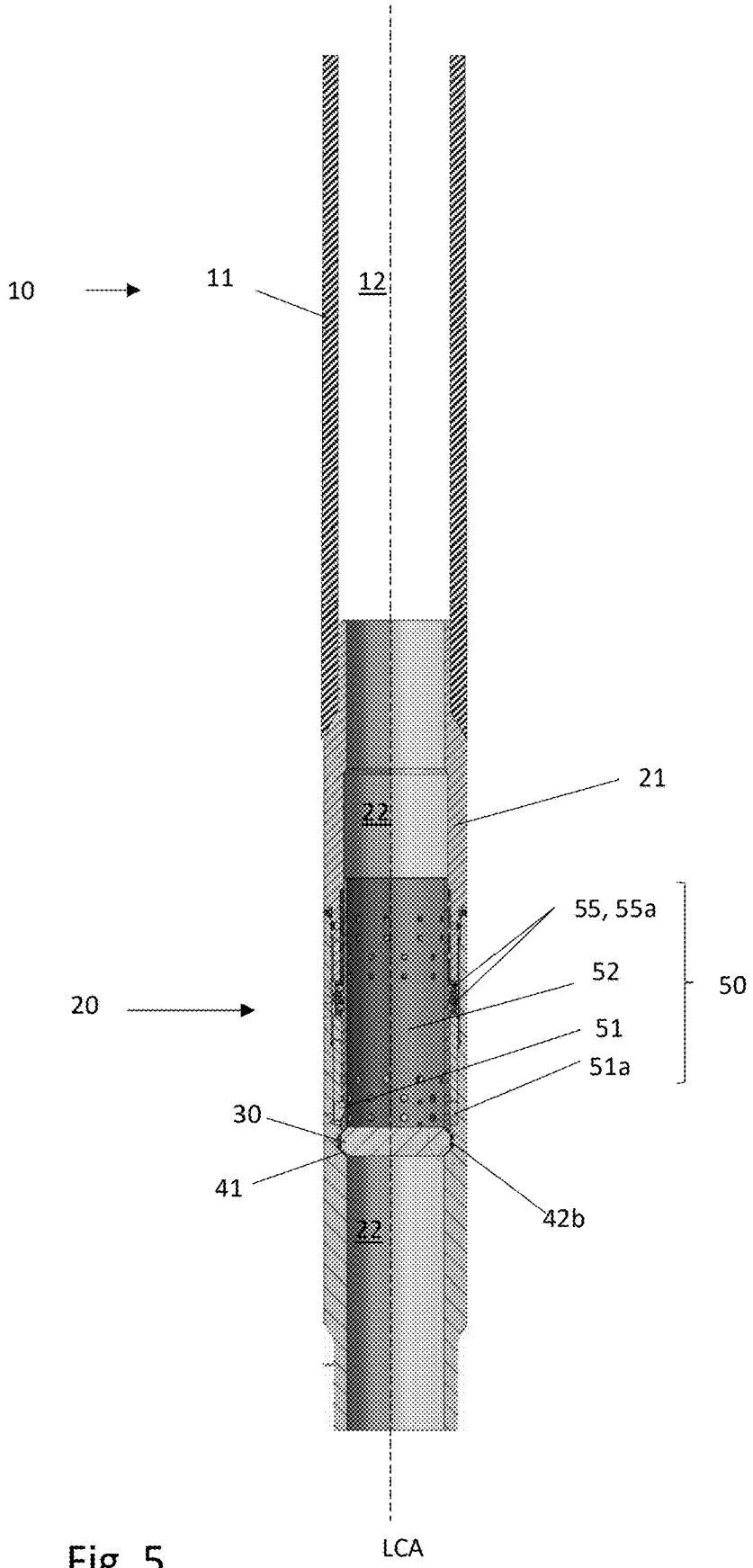
FIG. 5 is a cross sectional view of a first embodiment of the stinger.

It is now referred to FIG. 5. Here it is shown that an upper end of the housing 21 is connected to a lower end of the pipe 11 via a threaded connection.

Initially, it should be mentioned that the stinger 1 is operable between two operational states. The first operational state is referred to as an initial state or closed state, in which fluid flow through the through bore 22 of the plug section 20 is prevented due to the frangible plug body 30 being sealingly engaged within the bore 22. The second operational state is referred to as an initial state or open state, in which fluid flow through the through bore 22 of the plug section 20 is allowed due to removal of the frangible plug body 30 from the bore 22.

The frangible plug body 30 is made of hardened glass. The frangible plug body 30 is shaped as a cylinder, with chamfered upper and lower edges, in order to transfer forces formed by the fluid difference over the body 30 into the housing 21.

In FIG. 5, it is shown that the housing 21 comprises a lower edge 41 forming a lower seat for the lower chamfered edge of the frangible plug body 30. Circumferentially around the body 30, a recess 42*b* is provided within the housing 21. In this recess 42*b*, a sealing element (not shown) is provided in order to provide that the body 30 is sealingly engaged within the bore 22.

The plug section 20 further comprises an actuating system 50 for operating the stinger 1 from the closed state to the open state.

This actuating system 50 comprises a disintegration device 51 provided within the bore 22 above the frangible plug body 30. The disintegration device 51 comprises one or several knife bodies secured to the housing 21 by means of a sleeve 51*a*, which may be referred to as a knife retaining sleeve 51*a*.

The actuating system 50 further comprises an upper supporting device 52 in the form of a upper retaining sleeve provided within the bore 22. A lower end of the upper supporting device 52 is forming an upper seat for the upper chamfered edge of the frangible plug body 30. This lower end of the upper supporting device 52 is inserted at least partially through the sleeve 51*a*. The upper supporting device 52 is connected to the housing 21 and is supporting the upper side of the frangible plug body 30 within the bore 22 in the closed state.

Both the sleeve 51*a* and the upper supporting device 52 comprises longitudinal slots in which the disintegration device is located. The longitudinal slots also ensure that the upper supporting device 52 can be moved upwardly in the longitudinal direction relative to the disintegration device.

The actuating system 50 further comprises a releasing system 55. The releasing system 55 is releasably connecting the upper supporting device 52 to the housing 21 in the closed state, and is releasing the upper supporting device 52 from the housing 21 in the open state.

In the present embodiment, the releasing system 55 comprises shear elements in the form of shear pins 55*a* designed to be sheared off when exposed to a predetermined mechanical load. In this case, the mechanical load is represented by the relative fluid pressure, i.e. the pressure difference within the bore 22 between the fluid pressure within the bore 22 of the housing 21 below the frangible plug body 30 and the fluid pressure within the bore 22 of the housing 21 above the frangible plug body 30. When the fluid pressure below the frangible plug body 30 is higher than the fluid pressure above the frangible plug body 30, the fluid difference will try to push the frangible plug body 30 and hence the upper supporting device 52 upwardly. The position of the upper supporting device 52 is maintained until the shear pins 55*a* cannot withstand the load anymore. When the shear pins 55*a* is sheared off, the upper supporting device 52 becomes displaced upwardly and the frangible plug body 30 moves into contact with the disintegration device 51, causing a disintegration of the frangible plug body 30. The stinger 1 is now in the open state, as longitudinal fluid flow is allowed through the bore 22 (and hence also through the bore 11).

The operation of the stinger 1 will now be described. In FIG. 2, the stinger 1 has been inserted into the polished bore receptacle PBR. An initial closed volume is indicated as a grey area CV0 in FIG. 2, defined by the volume within the polished bore receptacle PBR above the lower barrier LB, the volume within the stinger 1 below the frangible plug body 30 and the relatively small volume in the annulus A2 between the stinger 1 and the polished bore receptacle PBR below the sealing assembly SA.

Figure 3:
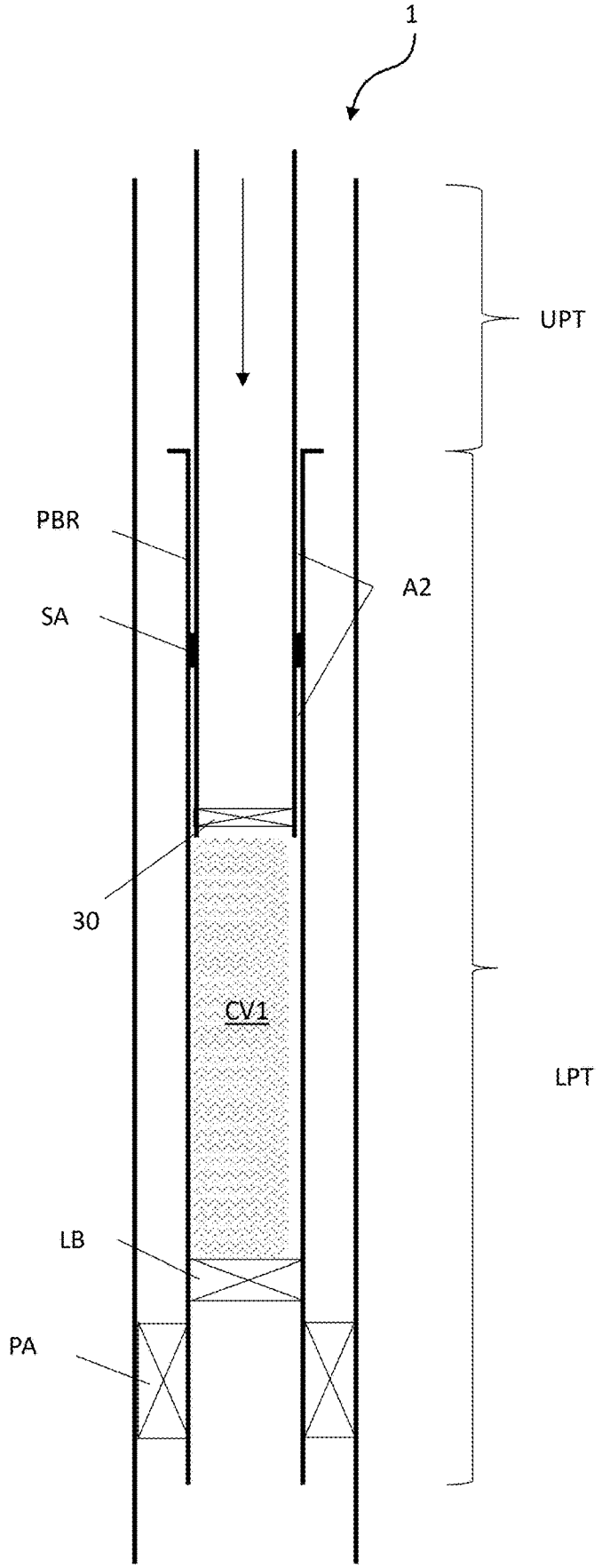
FIG. 3 schematically illustrates further insertion of the stinger into the polished bore receptacle, where a closed volume CV1 is indicating the closed volume when the stinger has been inserted a distance into the polished bore receptacle.

In FIG. 3, the stinger 1 has been pushed further down into the polished bore receptacle PBR. The above initial closed volume CV0 has now been reduced to the volume indicated as the grey area CV1. This volume CV1 is smaller than the volume CV0, causing the pressure below the frangible plug body 30 to increase.

Figure 4:
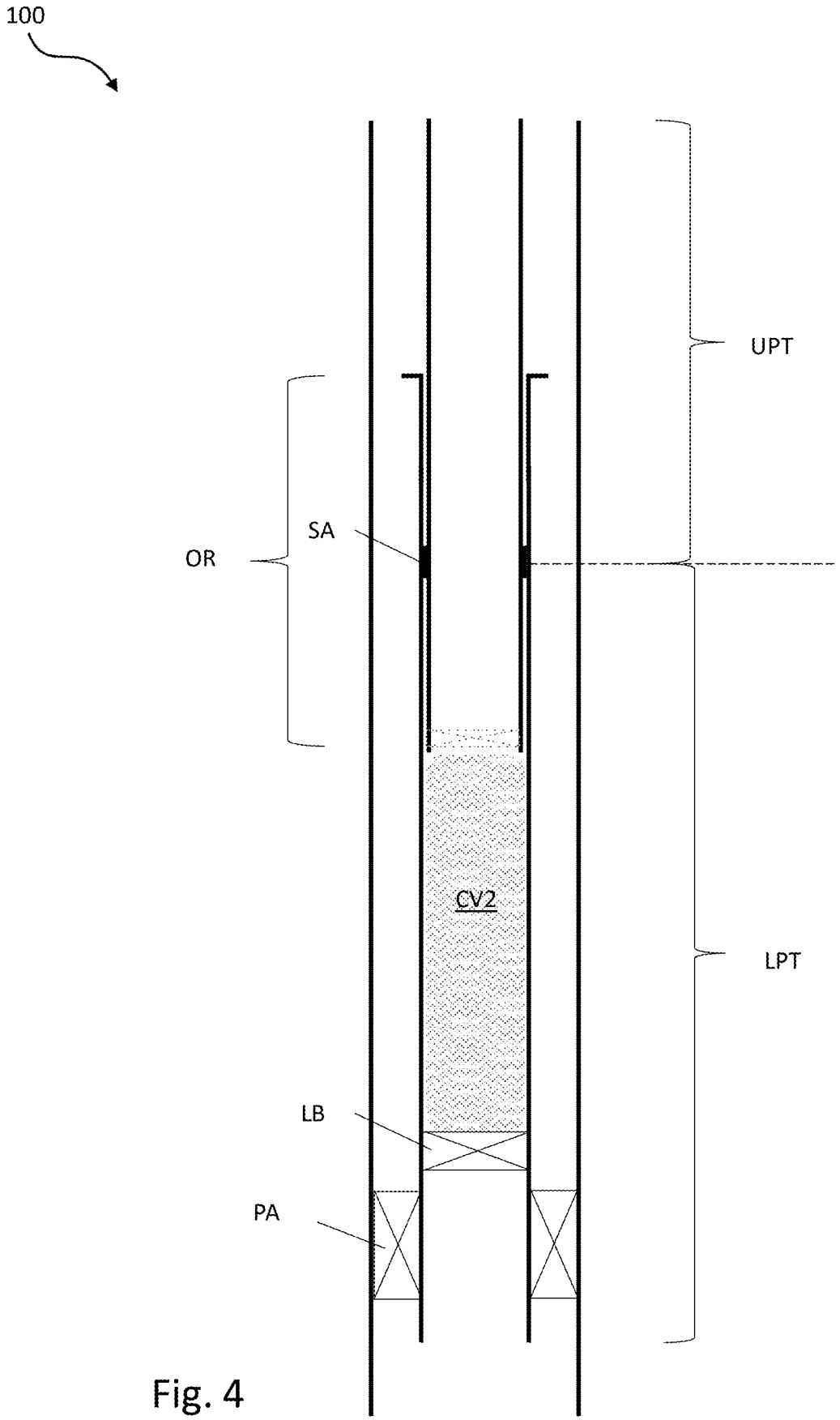
FIG. 4 schematically illustrates a further insertion of the stinger into the polished bore receptacle, where the frangible glass disc of the stinger has been disintegrated due to the pressure within the closed volume CV2.

In FIG. 4, the stinger 1 has been pushed further down into the polished bore receptacle PBR. The above initial closed volume CV0 has now been reduced to the volume indicated as the grey area CV2. This volume CV2 is smaller than the volume CV0 and the volume CV1, causing the pressure below the frangible plug body 30 to increase further. Here, the fluid pressure below the frangible plug body 30 and hence the pressure difference between the lower side of the frangible plug body 30 and the upper side of the frangible plug body 30 is sufficiently large to trig the releasing system 55, i.e. to shear of the shear pins 55*a*, causing the upper supporting device 52 to move upwardly and allowing the frangible plug body 30 to move up into contact with the disintegration device 51. As indicated by dashed lines in FIG. 4, the frangible plug body 30 is now disintegrated. By opening the lower barrier LB, fluid is now allowed to flow from the well below the packer PA and up to the topside.

As indicated in FIG. 4, the stinger 1, when inserted into the polished bore receptacle PBR, is forming an upper production tubing UPT. As discussed above, one object of the stinger and the polished bore receptacle PBR is to form an expansion joint allowing longitudinal expansion and retraction of the production tubing, for example due to temperature variations. Hence, the stinger 1 and the polished bore receptacle PBR is defined with an overlapping region OR in which the stinger 1 is provided radially inside the polished bore receptacle PBR. Hence, it is not necessarily a clear border between what is referred to as "lower production tubing LPT" and "upper production tubing UPT". In FIG. 4, it has been chosen to set the border at the sealing assembly SA. The overlapping region OR may have a length from ca 2 meters and up to the length of the stinger 1.

There are several advantages with the above solution. First, there is no separate operation of bringing the stinger 1 from the closed state to the open state, as this is achieved just by pushing the stinger 1 a sufficient distance into the polished bore receptacle PBR.

Second, it is achieved that completion fluid present in the well above the lower barrier LB and above the production packer PP can be held separate from the fluid inside the stinger 1. Typically, the completion fluid, serving as a temporary barrier during the operation, is a heavy fluid, which may damage the well formation below the production packer PP if the entire height of the well is filled with such completion fluid. By filling a lighter fluid such as brine within the stinger 1 above the frangible plug body 30, the well formation below the production packer PP will not be damaged when the stinger 1 is opened and the lower barrier LB is opened. Another advantage here is that the brine will typically come into contact with the production packer PP, or the contact with such fluid is considerably reduced. In some wells, the elastomeric material of the production packer is not compatible with brine. Typically, plugs are temporarily set in the production tubing to separate these fluids.

Third, the frangible plug body 30 serves as a shallow barrier in the production tubing. Typically, a separate trip into the well is needed to install such a shallow barrier.

Example 2

Figure 6:
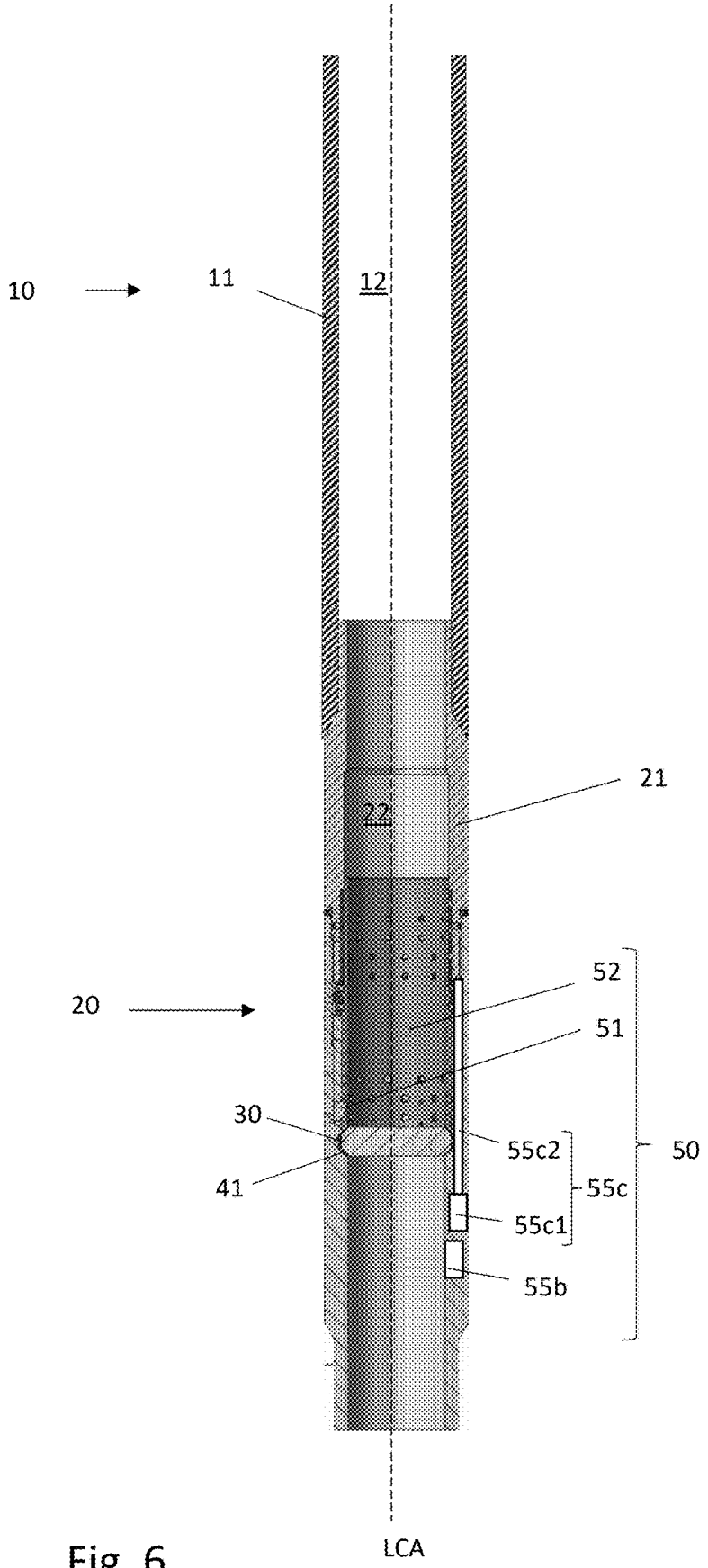
FIG. 6 is a cross sectional view of a second embodiment of the stinger.

It is now referred to FIG. 6. The stinger 1 of the second example is similar to the stinger 1 of the first example above, and only differences will be described below.

The releasing system 55 here comprises a pressure sensor 55*b* and an electric actuator 55*c*.

The pressure sensor 55*b* is mounted to the housing 21 below the frangible plug body 30 for sensing the fluid pressure within the bore 22 of the housing 21 below the frangible plug body 30.

The electric actuator 55*c* comprises a solenoid 55*cl* secured to the housing 21 and an actuation rod 55*c*2 movable by the solenoid 55*cl* secured to the upper supporting device 52.

The pressure sensor 55*b* is configured to send an actuation signal to the electric actuator 55*b* when a predetermined fluid pressure is measured. In this embodiment, the objective fluid pressure below the frangible plug body 30 is measured.

When the electric actuator 55*c* receives the actuation signal, the actuation rod 55*c*2 is moving the upper supporting device 52 upwardly, thereby allowing the frangible plug body 30 to move into contact with the disintegration device 51.

Alternatively, the actuation rod 55*c*2 is initially in a position in which movement of the upper supporting device 52 is prevented. When the electric actuator 55*c* receives the actuation signal, the actuation rod 55*c*2 is moved to a position in which movement of the upper supporting device 52 is no longer prevented. Here, the fluid difference over the frangible plug body 30 is moving the upper supporting device 52.

In yet an alternative, the actuation rod 55*c*2 is secured to the housing 21 by means of a shear pin, where the actuation rod 55*c*2 shears off the shear pin when receiving the actuation signal.

In addition, the releasing system 55 comprises a battery (not shown) for supplying electric power to the pressure sensor 55*b* and/or the electric actuator 55*c*.

In addition, the releasing system 55 may comprise a digital signal processor configured to send an actuating signal to the actuator based on information received from the sensor.

The operation of the stinger 1 of example 2 is done in the same way as in example 1, i.e. the stinger 1 is pushed down into the polished bore receptacle PBR until the pressure below the frangible plug body 30 becomes sufficiently high to trig the releasing system 55.

Example 3

The stinger 1 of the third example is similar to the stinger 1 of the second example above, and only differences will be described below.

Here, the electric actuator 55*c* is a pyrotechnic actuator with a pyrotechnic charge and an actuation rod. The pyrotechnic actuator is receiving the actuation signal from the pressure sensor 55*b*. Such a pyrotechnic actuator is sufficiently powerful to shear off any shear pins connected between the actuation rod and the housing 21.

The operation of the stinger 1 of example 3 is done in the same way as in example 1, i.e. the stinger 1 is pushed down into the polished bore receptacle PBR until the pressure below the frangible plug body 30 becomes sufficiently high to trig the releasing system 55.

Example 4

Figure 7:
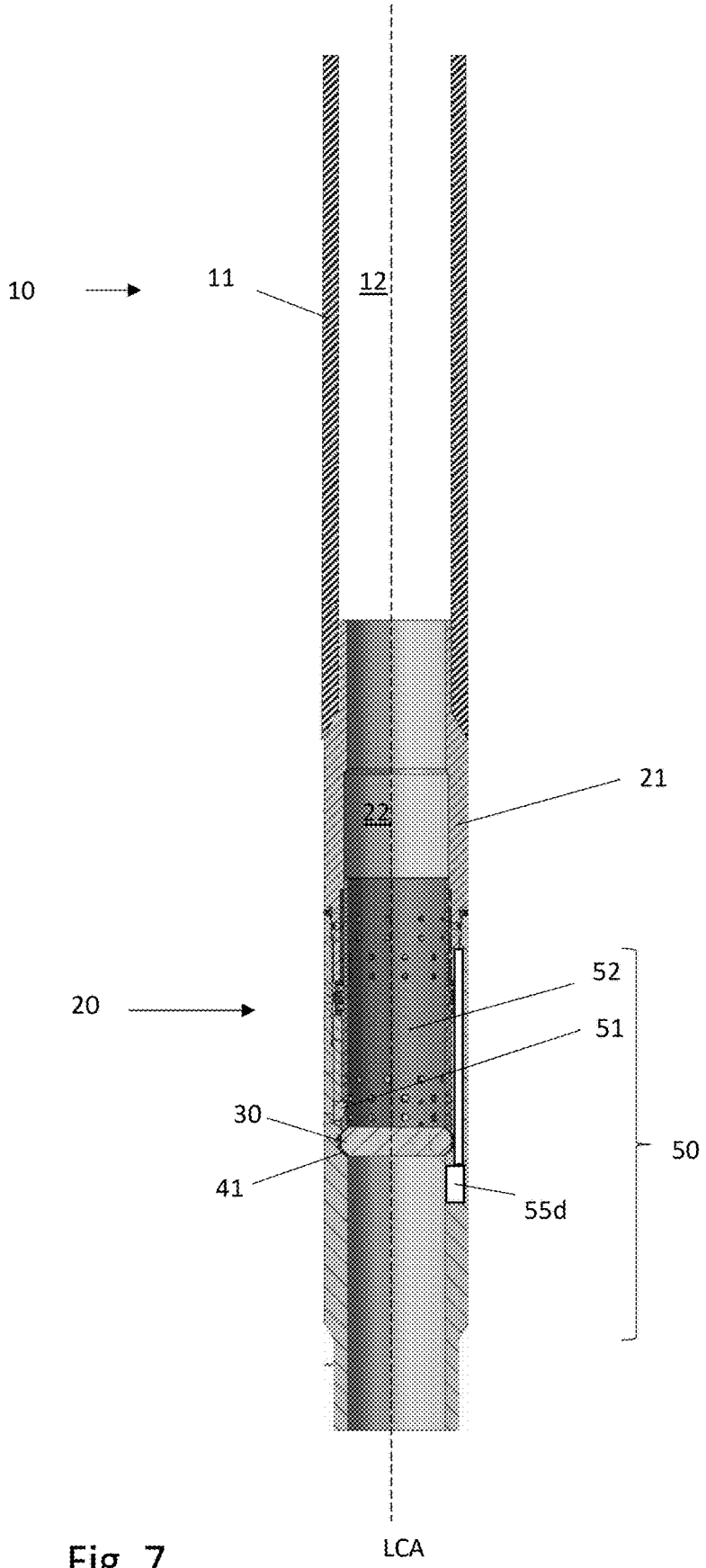
FIG. 7 is a cross sectional view of a third embodiment of the stinger.

It is now referred to FIG. 7. The stinger 1 of the fourth example is similar to the stinger 1 of the first example above, and only differences will be described below.

Here, the releasing system 55 comprises a pressure cycling mechanism 55*d* for counting a number of pressure cycles. When the predetermined number of pressure cycles have been counted, the upper supporting device 52 becomes released from the housing 21.

The pressure cycling mechanism 55*d* may be a mechanical pressure counting mechanism or an electrical pressure counting mechanism. Such pressure counting mechanisms are described in prior art, such as in NO 328882 or NO 338780.

The operation of the stinger 1 of example 4 is different from example 1. Here the stinger 1 is brought to the open state from the closed state as the stinger 1 is pushed down into polished bore receptacle PBR and up again a predetermined number of times, causing an increase in pressure and a subsequent decrease in pressure within the plug section 20 below the frangible plug body 30 the predetermined number of times to release the releasing system 55.

Example 5

It is now referred to FIG. 8*a*, FIG. 8*b*, FIG. 9*a* and FIG. 9*b*. The stinger 1 of the fifth example is similar to the stinger 1 of the first example above, and only differences will be described below.

Figure 8A:
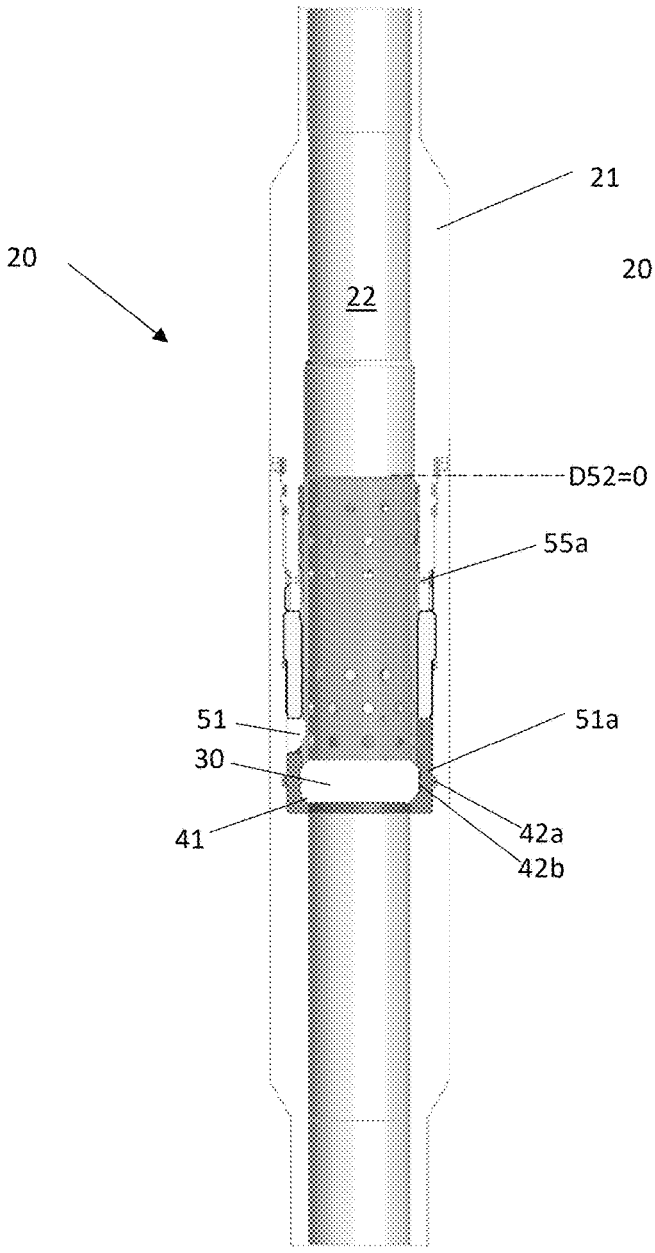
FIG. 8*a* illustrates a further embodiment of the plug section in the initial closed state.

In FIG. 8*a*, the lower edge 41 for supporting the lower side of the frangible plug body 30 is not a surface provided as part of the housing 21. The lower edge 41 is here provided as part of the sleeve 51*a*. Hence, the sleeve 51*a* is both supporting the lower side of the frangible plug body 30 and is supporting the disintegration device 51. Here, the sleeve 51*a* may be referred to as a lower retaining sleeve 51*a*, as it supports the lower side of the frangible plug body 30.

As shown in FIG. 8*a*, the lower end of the upper supporting device 52 is inserted partially into the sleeve 51 from above.

Figure 9A:
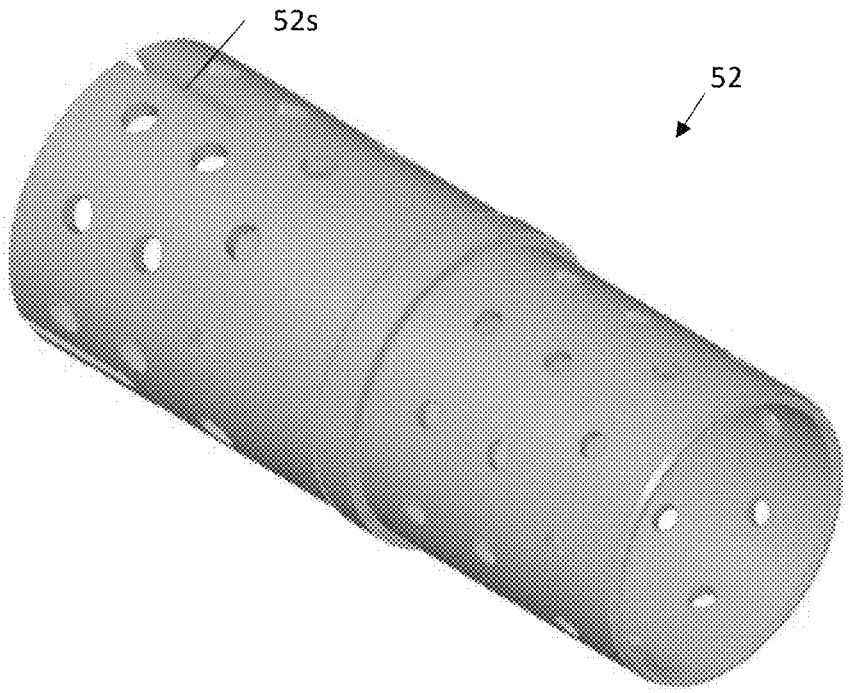
FIG. 9*a* is a perspective view of the upper supporting device of FIGS. 8*a* and 8*b;*
Figure 9B:
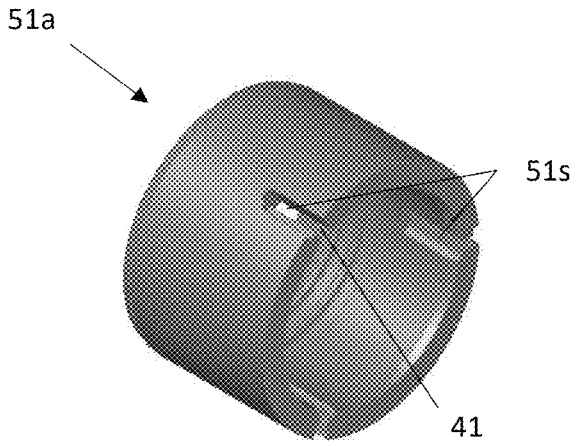
FIG. 9*b* is a perspective view of the lower retaining sleeve of FIGS. 8*a* and 8*b*.

In FIG. 9*a*, it is shown that the upper supporting device 52 is provided with slots 52*s* for the disintegration device 51. Similarly, in FIG. 9*b* it is shown that the sleeve 51*a* is provided with slots 51*s* for the disintegration device 51.

In FIG. 8*a*, it is further shown a recess 42*a* for a sealing element, to ensure that the sleeve 51*a* is sealingly engaged within the bore 22 of the housing 21. The sleeve 51*a* further has recesses 42*b* to ensure that the frangible plug body 30 is sealingly engaged within the sleeve 51*a*. Hence, also here the body 30 is sealingly engaged within the bore 22 of the housing 21.

Figure 8B:
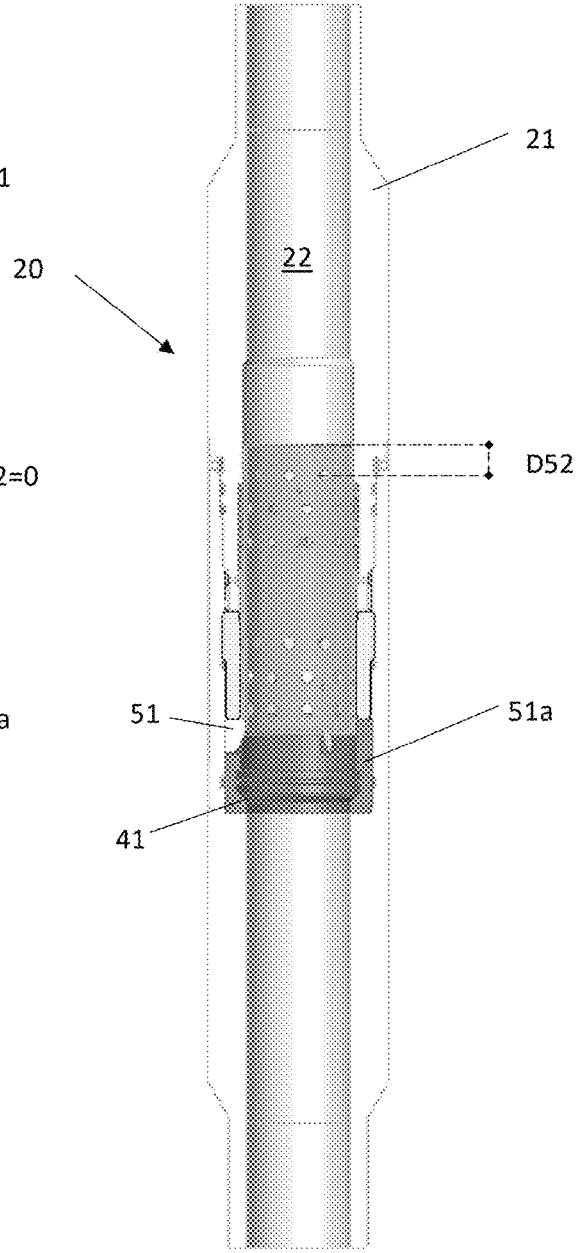
FIG. 8*b* illustrates the plug section of FIG. 8*a* in the final open state.

FIG. 8*b* shows the open state. Here it is shown that the upper supporting device 52 has moved upwardly a distance D52.

Further Examples

The above lower production tubing LPT and the upper production tubing UPT are together forming a production tubing assembly as indicated by reference number 100 in FIG. 4.

The following paragraphs are intended to demonstrate that certain features may be included together with other features in one or more embodiments of the disclosed invention. These are merely meant to be explicit examples of combinations of features and not an exhaustive list.

In one or more embodiments, a stinger (1) is for insertion into a polished bore receptacle (PBR), wherein the polished bore receptacle (PBR) is forming an upper end of a lower production tubing (LPT) and wherein the lower production tubing (LPT) is closed by a lower barrier (LB); wherein the stinger (1) comprises a pipe section (10) and a plug section (20); wherein the pipe section (10) comprises a pipe (11) having a through bore (12); wherein the plug section (20) comprises a housing (21) having a through bore (22); wherein an upper end of the housing (21) is connected to, or provided as part of, a lower end of the pipe (11) and the through bore (22) of the housing (21) is aligned below the through bore (12) of the pipe (11); wherein the stinger (1) is operable between at least two operational states, wherein the at least two operational states comprise a closed state in which fluid flow through the through bore (22) of the plug section (20) is prevented and an open state in which fluid flow through the through bore (22) of the plug section (20) is allowed; wherein the plug section (20) comprises a frangible plug body (30) sealingly engaged within the through bore (22) of the housing (21) in the closed state; wherein the plug section (20) comprises an actuating system (50) for operating the stinger (1) from the closed state to the open state; wherein the actuating system (50) comprises: a disintegration device (51) provided within the bore (22) above the frangible plug body (30); an upper supporting device (52) connected to the housing (21) and supporting an upper side of the frangible plug body (30) within the bore (22) in the closed state and released from the housing (21) in the open state, thereby allowing upward movement of the frangible plug body (30) into contact with the disintegration device (51) in the open state; and a releasing system (55) for releasably connecting the upper supporting device (52) to the housing (21) in the closed state; wherein the stinger (1) is brought to the open state from the closed state as the stinger (1) is pushed down into polished bore receptacle (PBR).

In the stinger (1) according to any one of the above embodiments, the releasing system (55) may be defined with a predetermined releasing threshold parameter representing the increase in pressure within the plug section (20) at which the releasing system (55) releases the upper supporting device (52) from the housing (21).

In the stinger (1) according to any one of the above embodiments, the predetermined releasing threshold parameter may be one of the following: a predetermined fluid pressure within the bore (22) of the housing (21) below the frangible plug body (30); or a predetermined number of fluid pressure cycles within the bore (22) of the housing (21) below the frangible plug body (30).

In the stinger (1) according to any one of the above embodiments, the releasing system (55) may comprise a shear element (55*a*).

In the stinger (1) according to any one of the above embodiments, the releasing system (55) may comprise an electric actuator (55*c*) for releasably connecting the upper supporting device (52) to the housing (21) and a pressure sensor (55*b*) for sensing the fluid pressure within the bore (22) of the housing (21) below the frangible plug body (30), wherein the pressure sensor (55*b*) is configured to send an actuation signal to the electric actuator (55*b*) when the predetermined fluid pressure is measured.

In the stinger (1) according to any one of the above embodiments, the releasing system (55) may comprise a pressure cycling mechanism (55*d*) for counting a number of pressure cycles, wherein the upper supporting device (52) is released from the housing (21) after a measuring a predetermined number of fluid pressure cycles within the bore (22) of the housing (21) below the frangible plug body (30).

In the stinger (1) according to any one of the above embodiments, the frangible plug body (30) may be a frangible glass disc.

In one or more embodiments, a production tubing assembly (100) comprises a lower production tubing (LPT) and an upper production tubing (UPT) above the lower production tubing (LPT); wherein an upper end of the lower production tubing (LPT) comprises a polished bore receptacle (PBR); characterized in that the upper production tubing (UPT) comprises a stinger (1) according to any one of the above claims inserted into the polished bore receptacle (PBR).

In one or more embodiments, a method for installing a production tubing in a well comprises the steps of: installing a lower production tubing (LPT) in the well, wherein an upper end of the lower production tubing (LPT) comprises a polished bore receptacle (PBR); installing a stinger (1) into the polished bore receptacle (PBR), wherein fluid flow through the stinger (1) is prevented by a frangible plug body (30) sealingly engaged within a through bore (22) of a housing (21) of a plug section (20) of the stinger (1) when the stinger is in a closed state; bringing the stinger (1) from the closed state to its open state by pushing the stinger (1) further down into polished bore receptacle (PBR), causing an increase in pressure within the plug section (20) below the frangible plug body (30) to disintegrate the frangible plug body (30). The method may include the stinger (1), which is a stinger according to any of the above embodiments.

LIST OF REFERENCE NUMBERS

1 stinger
10 pipe section
11 pipe
12 bore
20 plug section
21 housing
22 bore
30 frangible plug body
41 lower edge
50 actuating system
51 disintegration device
51*a* sleeve
52 upper supporting device
55 releasing system
55*a* shear pins
55*b* pressure sensor
55*c* electric actuator
55*cl* solenoid
55*c*2 actuation rod
55*d* pressure cycling mechanism
100 production tubing assembly
A1 annulus outside of the lower production tubing and inside of the casing
A2 annulus outside of the stinger and inside of the polished bore receptacle
CA casing
CV0 initial closed volume
CV1 volume
CV2 volume
LB lower barrier
LCA longitudinal center axis
LPT lower production tubing
OR overlapping region
PA packer
PBR polished bore receptacle
PP production packer
SA sealing assembly

What is claimed is:

1. A stinger for insertion into a polished bore receptacle, wherein the polished bore receptacle is forming an upper end of a lower production tubing and wherein the lower production tubing is closed by a lower barrier;

wherein the stinger comprises a pipe section and a plug section; wherein the pipe section comprises a pipe having a through bore; wherein the plug section comprises a housing having a through bore; wherein an upper end of the housing is connected to, or provided as part of, a lower end of the pipe and the through bore of the housing is aligned below the through bore of the pipe; wherein the stinger is operable between at least two operational states, wherein the at least two operational states comprise a closed state in which fluid flow through the through bore of the plug section is prevented and an open state in which fluid flow through the through bore of the plug section is allowed; wherein the plug section comprises a frangible plug body sealingly engaged within the through bore of the housing in the closed state; wherein the plug section comprises an actuating system for operating the stinger from the closed state to the open state; wherein the actuating system comprises:

a disintegration device provided within the bore above the frangible plug body;

an upper supporting device connected to the housing and supporting an upper side of the frangible plug body within the bore in the closed state and released from the housing in the open state, thereby allowing upward movement of the frangible plug body into contact with the disintegration device in the open state; and a releasing system for releasably connecting the upper supporting device to the housing in the closed state;

wherein the stinger is brought to the open state from the closed state as the stinger is pushed down into the polished bore receptacle.

2. The stinger according to claim 1, wherein the releasing system is defined with a predetermined releasing threshold parameter representing the increase in pressure within the plug section at which the releasing system releases the upper supporting device from the housing.

3. The stinger according to claim 2, wherein the predetermined releasing threshold parameter is one of the following:

a predetermined fluid pressure within the bore of the housing below the frangible plug body; or a predetermined number of fluid pressure cycles within the bore of the housing below the frangible plug body.

4. The stinger according to claim 1, wherein the releasing system comprises a shear element.

5. The stinger according to claim 1, wherein the releasing system comprises an electric actuator for releasably connecting the upper supporting device to the housing and a pressure sensor for sensing the fluid pressure within the bore of the housing below the frangible plug body, wherein the pressure sensor is configured to send an actuation signal to the electric actuator when the predetermined fluid pressure is measured.

6. The stinger according to claim 1, wherein the releasing system comprises a pressure cycling mechanism for counting a number of pressure cycles, wherein the upper supporting device is released from the housing after a measuring a predetermined number of fluid pressure cycles within the bore of the housing below the frangible plug body.

7. The stinger according to claim 1, wherein the frangible plug body is a frangible glass disc.

8. A production tubing assembly comprising a lower production tubing and an upper production tubing above the lower production tubing; wherein an upper end of the lower production tubing comprises a polished bore receptacle; wherein the upper production tubing comprises a stinger inserted into the polished bore receptacle, wherein the stinger is for insertion into a polished bore receptacle, wherein the polished bore receptacle is forming an upper end of a lower production tubing and wherein the lower production tubing is closed by a lower barrier; wherein the stinger comprises a pipe section and a plug section; wherein the pipe section comprises a pipe having a through bore; wherein the plug section comprises a housing having a through bore; wherein an upper end of the housing is connected to, or provided as part of, a lower end of the pipe and the through bore of the housing is aligned below the through bore of the pipe; wherein the stinger is operable between at least two operational states, wherein the at least two operational states comprise a closed state in which fluid flow through the through bore of the plug section is prevented and an open state in which fluid flow through the through bore of the plug section is allowed; wherein the plug section comprises a frangible plug body sealingly engaged within the through bore of the housing in the closed state; wherein the plug section comprises an actuating system for operating the stinger from the closed state to the open state; wherein the actuating system comprises: a disintegration device provided within the bore above the frangible plug body; an upper supporting device connected to the housing and supporting an upper side of the frangible plug body within the bore in the closed state and released from the housing in the open state, thereby allowing upward movement of the frangible plug body into contact with the disintegration device in the open state; and a releasing system for releasably connecting the upper supporting device to the housing in the closed state; wherein the stinger is brought to the open state from the closed state as the stinger is pushed down into the polished bore receptacle.

9. A method for installing a production tubing in a well, wherein the method comprises:

installing a lower production tubing in the well, wherein an upper end of the lower production tubing comprises a polished bore receptacle;

installing a stinger into the polished bore receptacle, wherein fluid flow through the stinger is prevented by a frangible plug body sealingly engaged within a through bore of a housing of a plug section of the stinger when the stinger is in a closed state; and bringing the stinger from the closed state to its open state by pushing the stinger further down into polished bore receptacle, causing an increase in pressure within the plug section below the frangible plug body to disintegrate the frangible plug body;

wherein the stinger is a stinger for insertion into a polished bore receptacle, wherein the polished bore receptacle is forming an upper end of a lower production tubing and wherein the lower production tubing is closed by a lower barrier.

10. A method according to claim 9, wherein the stinger comprises a pipe section and a plug section; wherein the pipe section comprises a pipe having a through bore; wherein the plug section comprises a housing having a through bore; wherein an upper end of the housing is connected to, or provided as part of, a lower end of the pipe and the through bore of the housing is aligned below the through bore of the pipe; wherein the stinger is operable between at least two operational states, wherein the at least two operational states comprise a closed state in which fluid flow through the through bore of the plug section is prevented and an open state in which fluid flow through the through bore of the plug section is allowed; wherein the plug section comprises a frangible plug body sealingly engaged within the through bore of the housing in the closed state; wherein the plug section comprises an actuating system for operating the stinger from the closed state to the open state; wherein the actuating system comprises: a disintegration device provided within the bore above the frangible plug body; an upper supporting device connected to the housing and supporting an upper side of the frangible plug body within the bore in the closed state and released from the housing in the open state, thereby allowing upward movement of the frangible plug body into contact with the disintegration device in the open state; and a releasing system for releasably connecting the upper supporting device to the housing in the closed state; wherein the stinger is brought to the open state from the closed state as the stinger is pushed down into the polished bore receptacle.

* * * * *